US006571914B2

(12) United States Patent
Lee et al.

(10) Patent No.: US 6,571,914 B2
(45) Date of Patent: Jun. 3, 2003

(54) LIFTING APPARATUS FOR HIGH-PLACE WORK

(76) Inventors: Gye-Seok Lee, 771-28 Mok-dong, Yangchon-ku, Seoul (KR); Nam-Kyung Kim, 104-801 Hanyang 1 Apt. 925, Dongchun-dong, Yeonsu-ku, Inchon-City (KR)

( * ) Notice: Subject to any disclaimer, the term of this patent is extended or adjusted under 35 U.S.C. 154(b) by 0 days.

(21) Appl. No.: 09/906,183

(22) Filed: Jul. 16, 2001

(65) Prior Publication Data

US 2002/0020583 A1 Feb. 21, 2002

(30) Foreign Application Priority Data

Aug. 14, 2000 (KR) ..... 2000-46929

(51) Int. Cl.[7] ..... E06C 1/00; B66B 9/02; E04H 12/18; B65H 75/48

(52) U.S. Cl. ..... 182/69.4; 187/250; 242/390.2; 52/108; 182/41; 182/141

(58) Field of Search ..... 182/69.4, 41, 69.6, 182/62.5, 63.1, 48, 141; 187/267, 268, 270, 271, 254, 250; 242/390.2, 390.3; 52/108, 632, 745.19, 745.17, 745.18; 248/161

(56) References Cited

U.S. PATENT DOCUMENTS 1,531,982 A * 3/1925 Sago ..... 182/41
2,661,082 A * 12/1953 Ziegler ..... 52/108
3,016,988 A * 1/1962 Browning ..... 187/250
3,213,573 A * 10/1965 Bohr et al. ..... 52/108
3,457,685 A * 7/1969 Stein ..... 52/108
3,596,735 A * 8/1971 Denier ..... 182/63.1 X
3,811,633 A * 5/1974 Cummings et al. ..... 52/108
4,386,485 A * 6/1983 Kramer ..... 52/108
4,651,480 A * 3/1987 Kramer ..... 52/108
4,920,710 A * 5/1990 Paine ..... 52/108
5,025,606 A * 6/1991 Mc Ginnis et al. ..... 52/108 X
5,099,950 A 3/1992 Kishi
5,139,110 A 8/1992 Kishi
5,347,770 A * 9/1994 Mc Donnell et al. ..... 52/108
6,112,474 A * 9/2000 Paine ..... 52/108

* cited by examiner

*Primary Examiner*—Daniel P. Stodola
*Assistant Examiner*—Hugh B. Thompson
(74) *Attorney, Agent, or Firm*—Anderson Kill & Olick; Eugene Lieberstein; Michael N. Meller

(57) ABSTRACT

A lifting apparatus for high-place work which includes a moving supporting leg having a guiding case with opposite open ends and plural walls, guiding grooves attached to said walls, plural elastic strips, a plurality of connecting pieces transversely attached to said elastic strips with the connecting pieces having a proportional number composed of shorter and longer lengths with the longer connecting pieces having fitting grooves on ends thereof, which matingly engage the ends of the shorter connecting pieces. The elastic strips are rotatably wound about respective winding drums disposed on the loading box of a vehicle and driven a driving force originating from the power source of the vehicle such that by unwinding the respective elastic strips an integrated column is formed at a desired elevated high location.

10 Claims, 9 Drawing Sheets

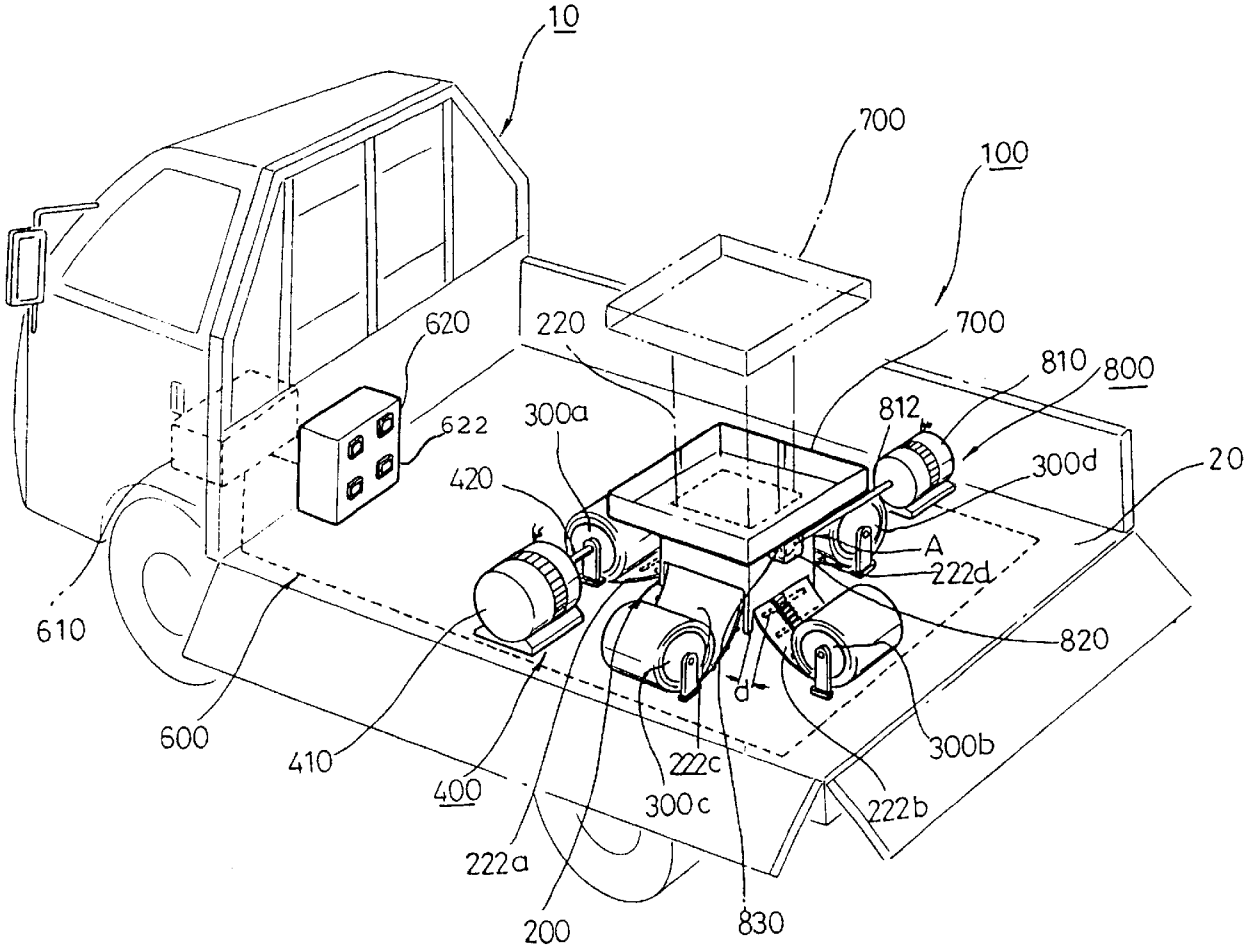
【FIG. 1】

【FIG. 2】
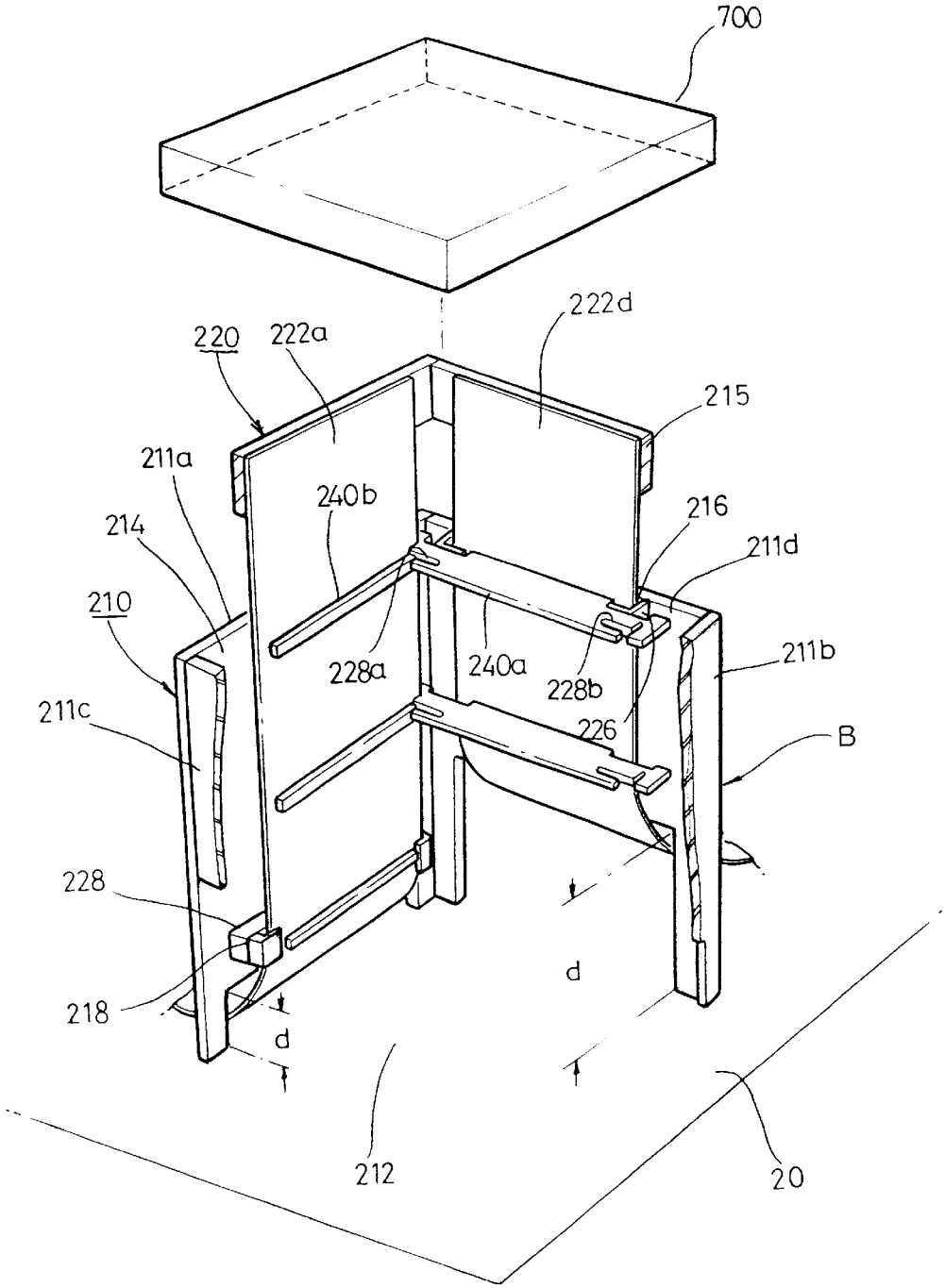

【FIG. 3】
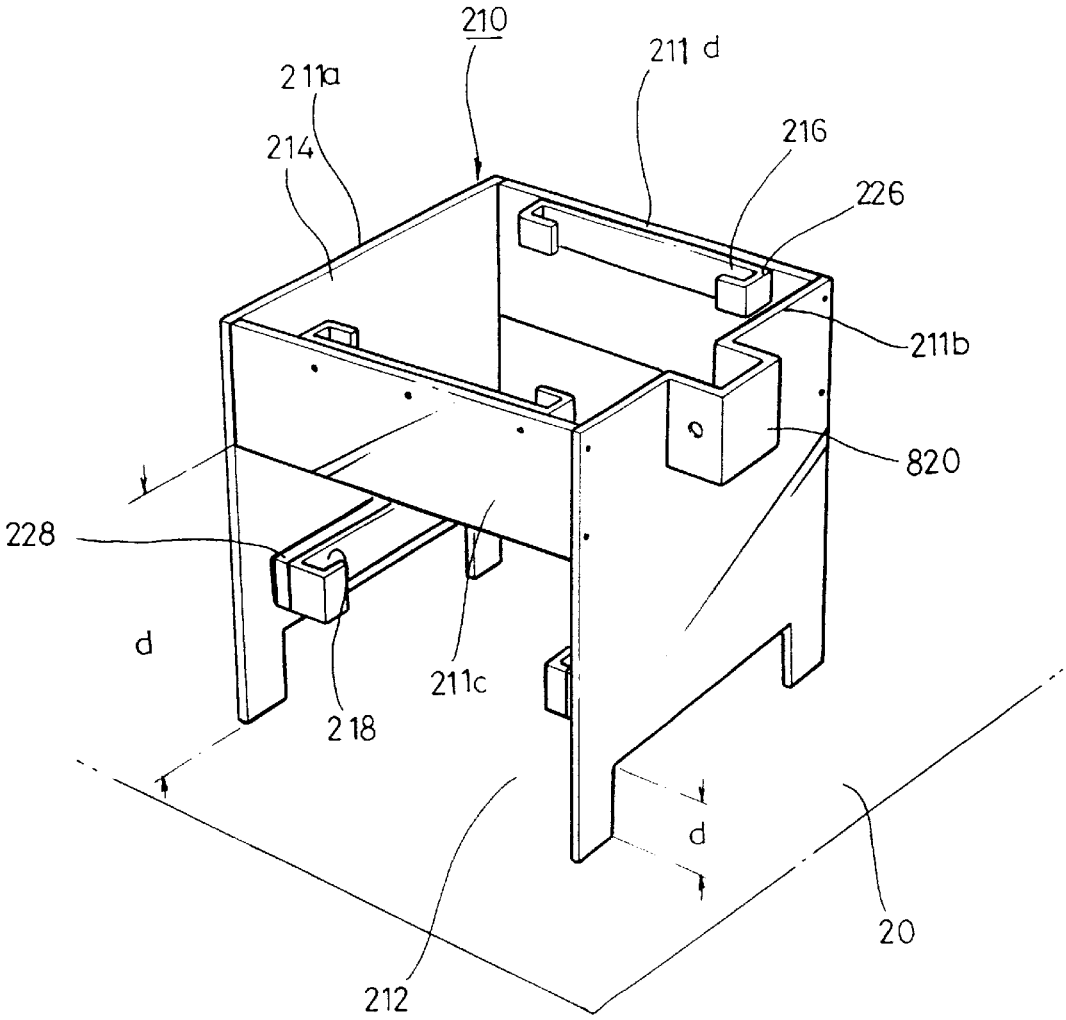

【FIG. 4】
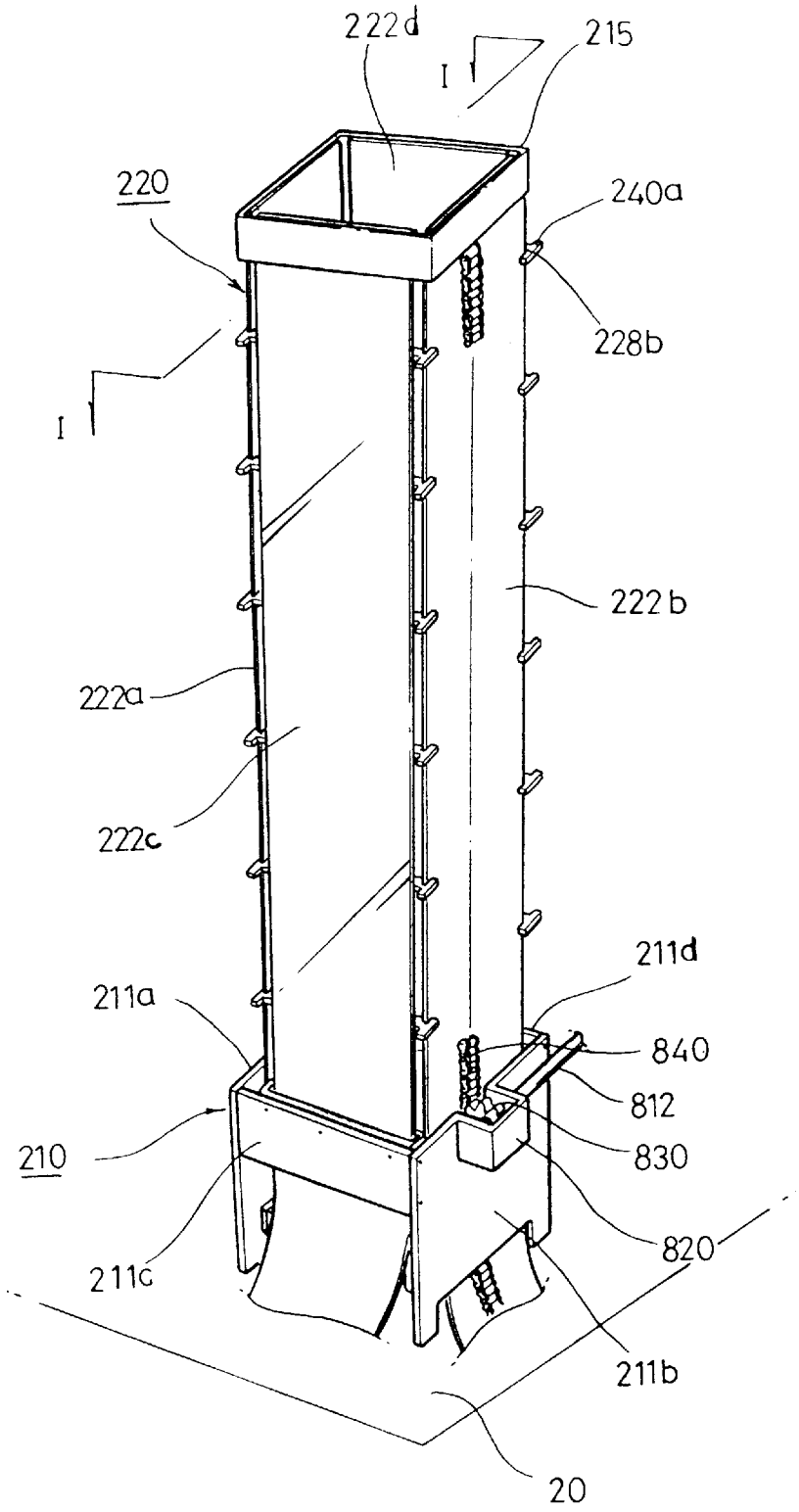

【FIG. 5】
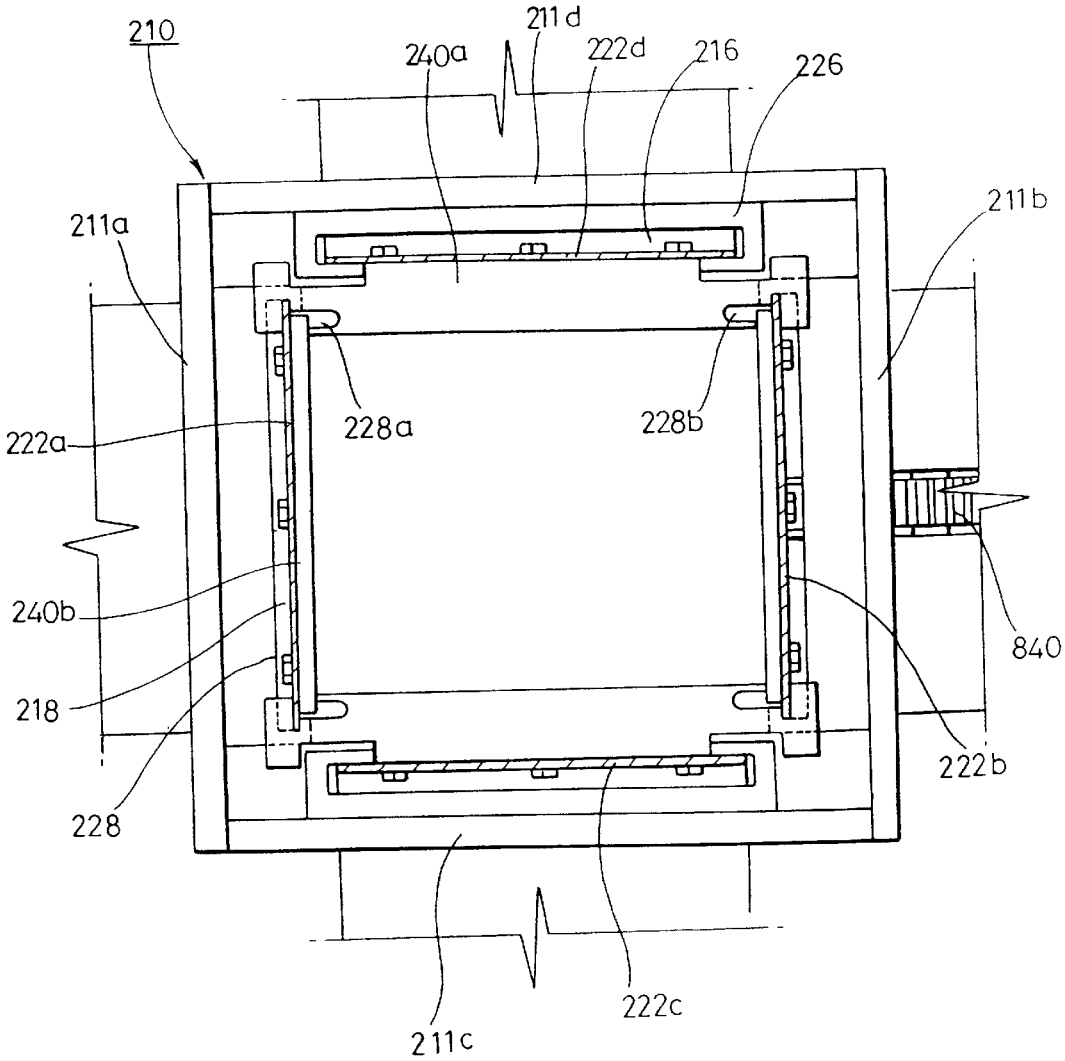

【FIG. 6】
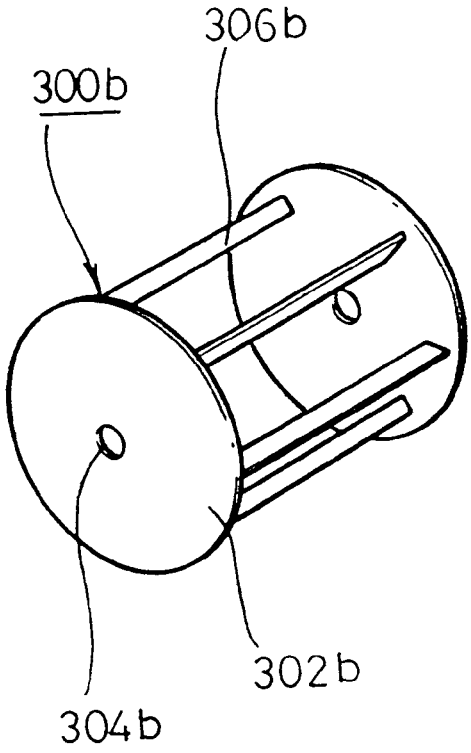

【FIG. 7】
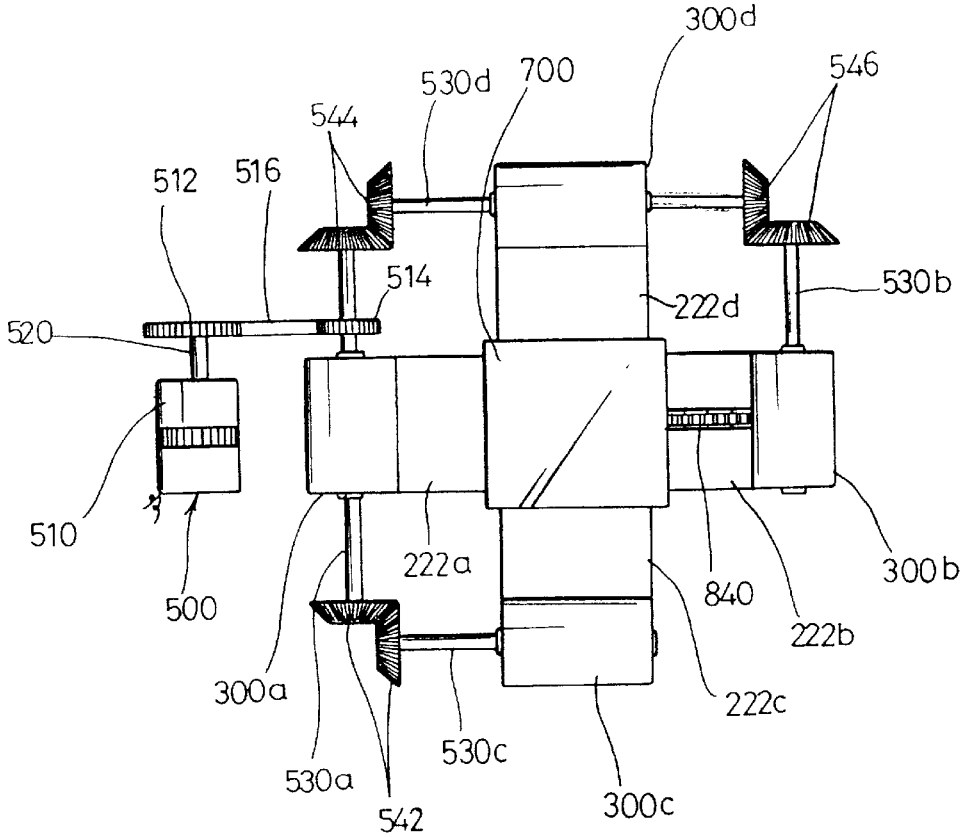

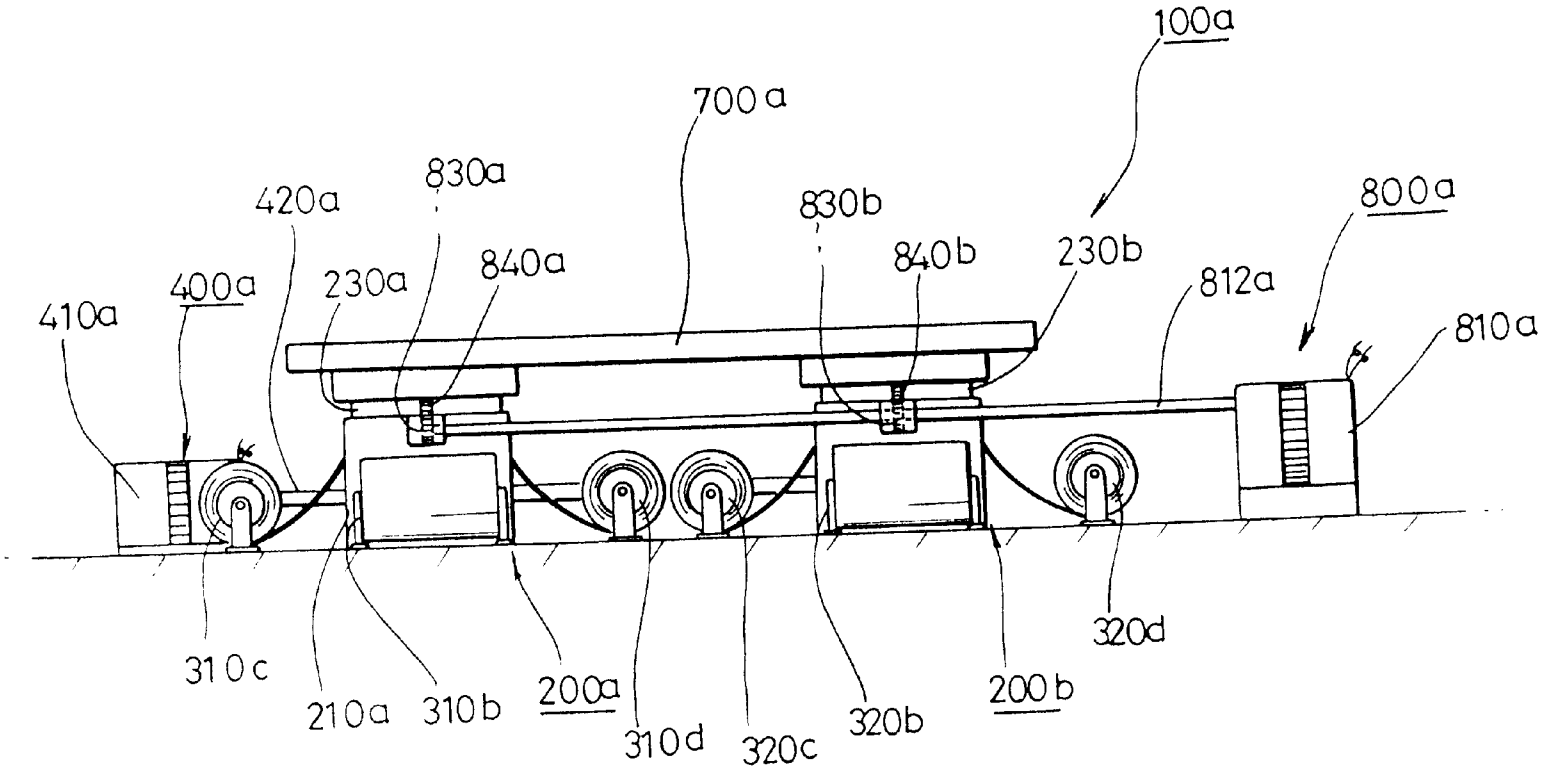
【FIG. 8】

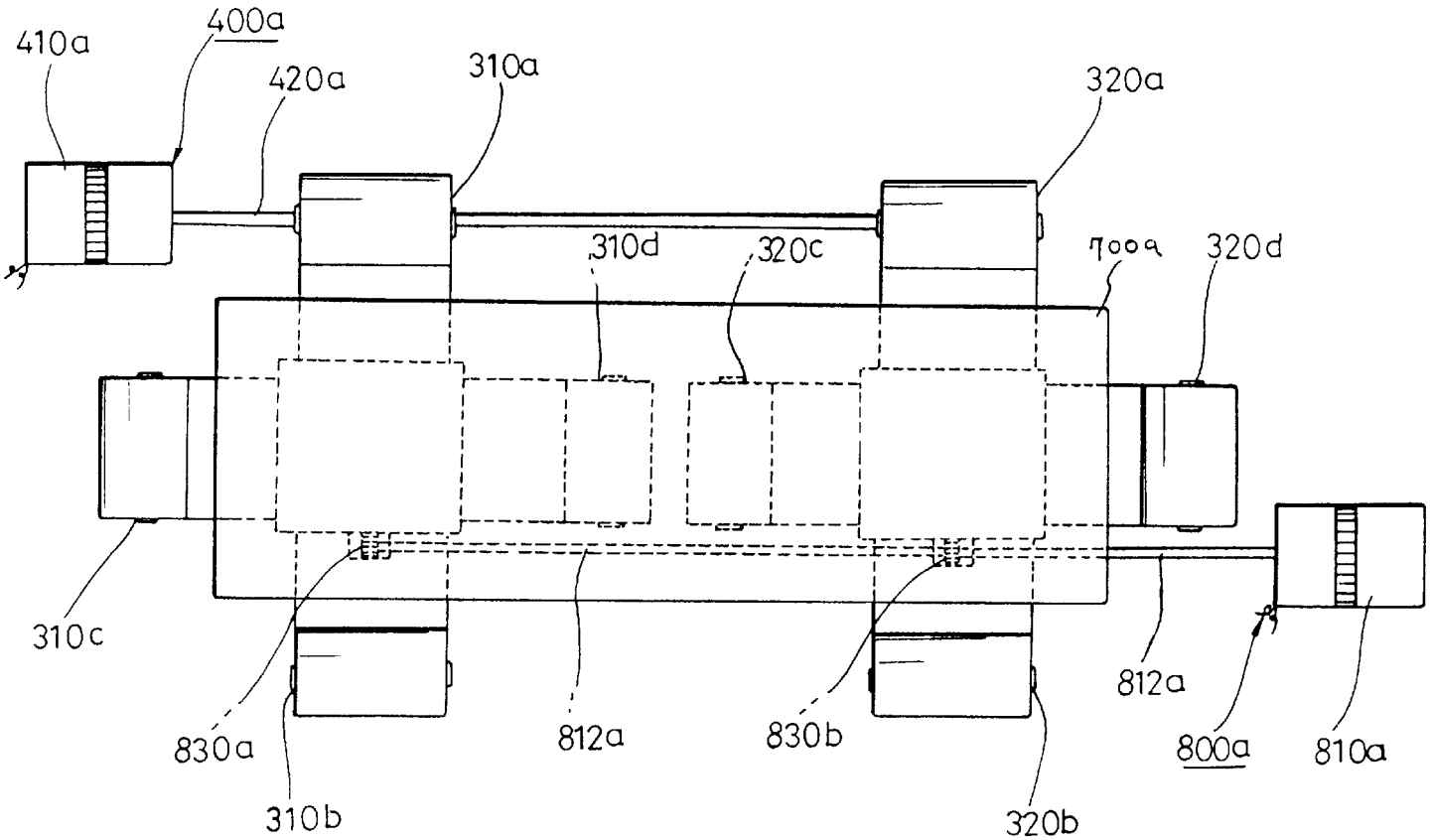
[FIG. 9]

LIFTING APPARATUS FOR HIGH-PLACE WORK

FIELD OF THE INVENTION

The present invention relates to a lifting device for high-place work to be used for painting or cleaning work at high apartments or buildings, fire extinguishing work at high buildings, transferring work for house-moving packs at high apartment houses or buildings, checking high place traffic facilities, electric inspection or work and the like and more particularly to a lifting apparatus for elevation work which allows access to a high place by forming a continuous supporting leg with elastic strip unwound from a winding drum.

BACKGROUND OF THE INVENTION

Generally, extensible elevated ladder equipments with the telescopic structure are used in painting or cleaning work at multi-storied apartments or buildings, fire extinguishing work at high buildings, transferring work for house-moving packs at high apartment houses or buildings and the like.

However, for those elevated ladder vehicles with the telescopic structure, moving to an elevated position is in fact restricted due to the weight of loads, and other factors like mechanical structural features of the equipments. Therefore, conventionally in washing or painting for multi-storied buildings, workers had to conduct the job, with their bodies supported on ropes or the like hanging from the rooftop of the buildings, wherein risks of safety accidents including falls exist because of unstable state and so on.

SUMMARY OF THE INVENTION

Accordingly, the object of the invention is to provide a lifting apparatus for elevation work, wherein the disadvantages with conventional art are resolved and any elevated location is easily accessed without the restriction of height to conduct the desired work stably and conveniently.

The above object is achieved according to the invention by a lifting apparatus for high-place working comprising a supporting leg consisting of a guiding case in the form of a hollow rectangular box with opposite ends open, mounted at a spacing above the floor surface and provided, on its inner walls, with guiding grooves with a side open, plural elastic strips provided movably through respective guiding grooves and an upper opening from the underside of the guiding case for forming an integrated rectangular column and each having a predetermined length, and connecting pieces attached on the respective elastic strips at a constant interval over the total length of elastic strips for giving the elastic strips supporting force so as to move to a high place in the form of a rectangular column through fitting engagement of the elastic strips, the connecting pieces having different length; winding drums disposed rotatably on the floor surface at positions corresponding to the respective elastic strips in the moving supporting leg for winding the elastic strips in the form of roll; a first driving means disposed in the vicinity of the moving supporting leg for furnishing to the winding drums driving force to wind the elastic strips through an axial connection to one of the winding drums; a second driving means disposed contiguous to one of the elastic strips of the moving supporting leg at a position isolated from the first driving means for furnishing a driving force to control the movement of the moving supporting leg in relation with the operation of the first driving means; and a controlling means for controlling the switching on or off of the first and second driving means.

The guiding case is preferably formed of metal plates with predetermined area and the guiding grooves are provided at the top position for two opposite metal plates and at the bottom position for the other two opposite metal plates.

Also, preferably, the top parts of the elastic strips forming the rectangular column in the moving supporting leg are integrally combined by a wrapping frame in the form of a band.

Further, the connecting pieces are desirably formed of metal members with a predetermined strength and fixed transversely to the elastic strips in a detachable manner, and the connecting pieces out of all the connecting pieces exceeding the width of elastic strips in length are formed, on their opposite ends, with fitting grooves to synchronously engage and fix the ends of the shorter connecting pieces and the ends of the elastic strips attached with the shorter connecting pieces.

It is preferably provided that the moving supporting leg is formed, on its top end, with a working stand for high-place workers.

According to a preferable detail, the first driving means consists of a reversible motor and the second driving means comprises a ratchet gear rotatably mounted in the ratchet gear box which is formed, with the side toward the column open, on a side wall of the guiding case, so that the ratchet gear can be meshed in the chain provided over the full height of the elastic strip facing the gear box on the supporting leg, and a driving motor connected axially to the ratchet gear for transmitting, through a shaft, driving force to cause the meshing with the chain and for controlling the movement of the moving supporting leg.

Preferably, the controlling means comprises a control box having operation buttons, which allow selective on/off operation of one or both of the driving apparatuses, through an electric circuit of a power supplying battery electrically connected with the first and second driving apparatuses.

According to another aspect of the invention, two or more lifting apparatuses for high-place working are disposed in interlocking manner and support a single working stand.

The lifting apparatus for high-place working according to the invention is desirably installed on a transporting means such as a vehicle for the convenience of mobility.

Accordingly, as the height of the supporting leg or rectangular column can be determined by the length of the elastic strips wound on a winding drum, any high place can be approached within the strip length wound on the drum, so that the desired high-place work can be conducted stably.

BRIEF DESCRIPTION OF THE DRAWINGS

FIG. 1 shows the perspective view of a lifting apparatus for high place work according to an embodiment of the invention, as mounted on a vehicle, FIG. 2 shows the enlarged perspective view of the "A" portion of FIG. 1, partly cut away and partly dismantled, FIG. 3 shows the enlarged perspective view of the "B" part of FIG. 2, FIG. 4 shows the perspective view of the "A" portion of FIG. 1, as moved upward in upright posture, FIG. 5 shows the enlarged plan view in cross section taken along the line I—I in FIG. 4, FIG. 6 shows the perspective view illustrating the appearance of the winding drum shown in FIG. 1, FIG. 7 shows the view, as seen from the above side, of another variant of driving apparatus employed in the lifting apparatus for high-place work according to the invention, FIG. 8 shows the front view of the lifting apparatus for high-place work according to another embodiment of the invention and FIG. 9 shows the plan view of FIG. 8.

DETAILED DESCRIPTION OF THE INVENTION

Preferred embodiments of the invention will be described in detail below by referring to the accompanying drawings.

As shown in the drawings, the lifting apparatus 100 for elevation work according to the invention includes a moving supporting leg 200, so that the lifting apparatus can be installed on the loading box 20 of a transporting means like a vehicle 10 for the purpose of convenient mobility. The moving supporting leg 200 which is a structure capable of moving to a high location from the loading box 20 comprises a guiding case 210, elastic plate strips 222*a*~222*d* and connecting pieces 240*a* and 240*b*.

As may be understood from FIG. 3, the case 210 forms a rectangular box of hollow structure, with two opposite ends, for example, the top and bottom ends being open as openings 212 and 214, is installed on the loading box 20 of a vehicle 10 at a spacing d from the floor surface of the box and is provided, on the inner walls, with guiding grooves 216 and 218 partly opened, so that the elastic strips 222*a*~222*d* may be guided through the above-described openings 212 and 214. The elastic strips 222*a*~222*d* form a rectangular column, as it moves through the inside of the guiding case 210, which will be further explained later. The guiding case 210 is formed of high-strength metal plates 211*a*~211*d* having a predetermined area through the combined method of welding and clamping or the like and its size, i.e. the height and area, may vary depending on the size of the elastic strips 222*a*~222*d*.

A guiding member, e.g. 226 in FIG. 2, for forming a guiding groove 216 of the guiding grooves 216 and 218 is provided at the top inside area of each of opposite metal plates 211*c* and 211*d*, while the other guiding member 228 for forming the other groove 218 is provided at the bottom area of each of the other opposite metal plates 211*a* and 211*b*. The alternate provision of the guiding grooves 216 and 218 at the top and bottom areas of the metal plates 211*a*~211*d* is intended to guide elastic strips 222*a*~222*d* in an effective manner. The guiding grooves 216 and 218 may be either formed directly on the metal plates 211*a*~211*d* or may be formed by means of separate guiding members 226 and 228 as seen in FIG. 3. The guiding members 226 and 228 can be fixed to the metal plates 211*a*~211*d* by electric welding or screw-fixing.

The elastic strips 222*a*~222*d* are each formed of a metallic body in plate form having a predetermined bending strength, such as a general sheet metal coil. Elastic strips 222*a*~222*d* with a long length are each introduced from the lower outside, by one ends, or the top ends in FIG. 2, through the gaps d between the floor surface of the loading box 20 and the lower edges of guiding case 210, then through the lower opening 212 and guided up through the guiding grooves 216 and 218 of the case 210 up to the upper opening 214, now as upright sheet bodies, to reach the upper outside, whereby the elastic strips 222*a*~222 form substantially a rectangular column by means of the guiding case 210, as shown in FIGS. 1 and 2. The other ends of the elastic strips 222*a*~222*d* are wound and anchored, in a cylindrical form, on the circumference of winding drums 300*a*~300*d*, as will be further explained in the following. The elastic strips 222*a*~222*d* forming substantially a rectangle form above the guiding case 210 are connected integrally on their top ends by a frame 215 to constitute an integrated rectangular column 220, as seen in FIGS. 1 and 2, on the top of which column a working stand 700 for workers is provided. The elastic strips 222*a*~222*d* are moved up and down relative to the guiding case 210 in the form of rectangular column 220, wherein the height of the rectangular column 220 is controlled by the length of the elastic strips 222*a*~222*d*. The width of respective elastic strips 222*a*~222*d* is so decided as to pass through the guiding grooves 216 and 218 on the guiding case 210, and the length and thickness of elastic strips 222*a*~222*d* are preferably decided to be adapted to wind around the winding drums 300*a*~300*d* as will be described in more detail later, wherein the width and length of the strips may be varied in accordance to the change in the size of the grooves 216 and 218 or the change in the size of the winding drums 300.

The above-described connecting pieces 240*a* and 240*b* serve to unite the elastic strips 222*a*~222*d* so as to form an integrated rectangular column 220 having a firm bearing force, as the strips move out from the guiding case 210 forming the rectangular column 220. Because the elastic strips 222*a*~222*d* are united so as to form an integrated rectangular column 220 by the help of the connecting pieces 240*a* and 240*b*, they can have supporting and reinforcing force large enough to move the column body 220 as moving from the case 210 firmly to a desired high position. In other words, the connecting pieces 240*a* and 240*b* are made of high strength metal members and distributed at a constant interval over the total length of the elastic strips 222*a*~222*d*.

Accordingly, in the case that the elastic strips 222*a*~222*d* are moved upward under the guidance of the guiding grooves 216 and 218 on the guiding case 210, at the instant when the connecting pieces 240*b* which are shorter than the width of elastic strips and provided on the opposite elastic strips 222*a* and 222*b* meet with the corresponding connecting pieces 240*a* which exceed the width of elastic strips and provided on the opposite elastic strips 222*c* and 222*d*, as the strips move up, the elastic strips 222*a* and 222*b* together with the connecting pieces 240*b* are fitted in the structured grooves 228*a* and 228*b* formed on the opposite ends of the connecting pieces 240*a*, as seen FIGS. 2 and 5, so that the elastic strips 222*a*~222*d* form a continuously lengthening integrated rectangular column 220, as they move upward through the upper opening 214 of the guiding case 210, as depicted in FIGS. 1 and 4. Therefore, even though the rectangular column 220 is proceeding to a high elevation, the column stays upright continuously without warping to one side or bending due to the reinforcing force exhibited by the connecting pieces 240*a* and 240*b* in such a manner as to keep the elastic strips 222*a*~222*d* integrated.

Correspondingly, when the rectangular column 220 moves down in contrast, the elastic strips 222*a*~222*d* forming the column 220 are moved to the outside through the gaps d from the lower opening 212 of the guiding case 210 to be wound around the winding drums 300*a*~300*d*, while the connecting pieces 240*a* and 240*b* which so far have been supporting the elastic strips 222*a*~222*d* integrally in engaged manner are automatically disengaged from one another.

The elastic strips 222*a*~222*d* are moved through the guiding case 210, with their top ends integrally combined by means of the frame 215. Accordingly, the connecting pieces 240*a* and 240*b* come into mutual engagement always at fixed positions, wherein the guiding grooves 218 are positioned protrudently in comparison to the guiding grooves 216 up to the position where the grooves 228*a* and 228*b* of the connecting pieces 240*a* are positioned, so that the elastic strips 222*a* and 222*b* with the connecting pieces 240*b* may be appropriately fitted in the corresponding opposite grooves 228*a* and 228*b* of the connecting pieces 240*a* on elastic strips 222*c* and 222*d*. Further, because the connecting pieces 240*a* are formed longer than and at a spacing from the grooves 216 and the connecting pieces 240*b* are shorter than the grooves 218 on the same elastic strips, the elastic strips 222*a*~222*d* can travel smoothly without interference under the guidance of guiding grooves 216 and 218 formed on the guiding case 210.

On the loading box 20 of a vehicle 10, there are disposed rotatable winding drums 300*a*~300*d* for winding elastic strips 222*a*~222*d* in a roll form from the bottom of the strip column 220, at the positions corresponding to the respective elastic strips 222*a*~222*d* in the supporting leg 200. As the winding drums 300*a*~300*d* are all the same in the construction, the winding drum 300*b*, for example, as a representative in FIG. 1 is explained by referring to FIG. 6.

FIG. 6 shows the perspective view illustrating the appearance of a winding drum shown in FIG. 1, wherein the winding drum 300*b* comprises two discs 302*b* each having an axial hole 304*b*, which discs are connected integrally by connecting members 306*b* arranged concentrically, an elastic strip 222*b* being wound around the connecting members. The winding drums 300*a*~300*d* are rotated by driving shafts received in the axial holes 304*b* and supported by bearings provided on the loading box 20. The size of the winding drums 300*a*~300*d* is determined depending on the length of elastic metal strips 222*a*~222*d*. The winding drums 300*a*~300*d* constructed as described above have winding force to keep the elastic strips wound in a roll form and their diameter is large enough to take care of the bending strength of the elastic strips. Therefore, the elastic strips 222*a*~222*d* attached with connecting pieces 240*a* and 240*b* can be wound around the winding drums without problem. The functions of keeping the elastic strips wound on the drums and imparting winding force are performed by the first driving apparatuses 400, which will be explained in more detail in the following.

The first driving apparatus 400 comprises a reversible driving motor 410 and is disposed on the loading box 20 in the vicinity of the moving supporting leg 200 to be in rotatable connection to any one winding drum 300*a* through a shaft 420, so that the driving motor 410 may transmit to the winding drums 300*a*~300*d* the driving force as required to wind the elastic strips 220*a*~220*d* from the supporting leg 200 by first transmitting the driving force to the winding drum 300*a*. The first driving apparatus 400 which is turned on or off by a power controller 600 causes to drive the winding drums 300*a*~300*d* to wind the elastic strips 222*a*~222*d*, when the rectangular column 220 of the support leg 200 falls from an imaginary position indicated in FIG. 1 to a position indicated by a solid line, at which position, a fully lowered position, the winding drums 300*a*~300*d* with rolls of elastic strips are caused to wind the elastic strips 222*a*~222*d* with their remaining momentum. As those driving motors 410, conventional ones may be used and so their explanation is not made. The first driving apparatuses 400 may be installed for each of the winding drums, but the driving force may be given to only one drum, because the elastic strips 222*a*~222*d* winding around the drums 300*a*~300*d* have an integrally united structure by the frame 215. Therefore, the apparatus can be installed for only one winding drum for cost reduction or simple construction, when a reserve is not considered. While the first driving apparatus 400 as mounted to the winding drum 300*a* was explained as an example, the apparatus may be mounted to another drum beside the winding drum 300*a*.

Regarding the moving supporting leg 200, the moving up and down, or stop of the rectangular column 220 are realized by the second driving apparatus 800 which is installed separately from the first driving apparatus 400 and controlled by another controller 600. The second driving apparatus 800 comprises a reversible driving motor 810 located at one side of the supporting leg 200 on the loading box of a vehicle 10.

The driving shaft 812 of the reversible driving motor 810 is connected to the ratchet gear 830 rotatably mounted in the ratchet gear box 820 which is formed, with the side toward the column 220 open, at the top middle position of a side wall, or the right side wall 211*b* of the guiding case 210 in FIGS. 3 and 4, so that the ratchet gear 830 can be meshed in the chain 840 provided over the full height of an elastic strip 222*b* composing the column 220. Accordingly, the driving force generated by the driving motor 810 and transmitted to the ratchet gear 830 through the driving shaft 812 causes the ratchet gear 830 to rotate and the resulting rotating force of the ratchet gear is transmitted to the chain 840 in mesh with the gear to thereby cause the movement of the column body 220 upward to the imaginary line position or down to the solid line position in FIG. 1. While depending on the normal or reverse rotation of the driving motor 810, the column 220 of the supporting leg 200 is accordingly moved up to the imaginary line position or down to the solid line position, the first driving motor 410 is brought to an inactive state in which no power is transmitted to winding drums 300*a*~300*d* to allow the winding drums to rotate freely, when the second driving motor 810 causes the elevation of the rectangular column 220 to the imaginary line position in FIG. 1 by rotating normally, for example. Therefore, the elastic strips 222*a*~222*d* can be easily unwound from the freely rotating drums 300*a*~300*d* to be fed into the inside of the guiding case 210 so as to form the column 220 capable of reaching a high location.

In contrast, in the case of moving the rectangular column 220 down to the lower position from the imaginary high position through the reverse rotation of the second driving motor 810, the first driving motor 410 is driven together with the second driving motor 810, differently from the foregoing example, to cause the elastic strips 222*a*~222*d* to be wound on the corresponding winding drums 300*a*~300*d*. Further, when the rectangular column 220 of a moving supporting body 200 positioned at a certain elevation over the guiding case 210 as shown in FIG. 1 or 4 is desired to maintain the stopping state, the second driving motor 800 is stopped or switched off to keep the ratchet gear 830 meshed in the chain 840. Preferably the first driving apparatus 400 is also ceased in operation temporarily to maintain the winding state of the elastic strips on the winding drums 300*a*~300*d*. The on/off control of the first and second driving apparatuses 400 and 800 performed by the controller 600 is explained further in the following. The second driving apparatus 800 as installed for the specific elastic strip 220*b* was described in the above example but it may be installed in conjunction with one of other elastic strips.

The controller 600 for the driving apparatuses 400 and 800 may be preferably installed in the driver's compartment of a vehicle for the convenience of operation but it may be installed on the side of the loading box 20 outside the vehicle as the case may be. The controller 600 comprises a control box 620 having operation buttons 622, which allow selective on/off operation of one or both of the driving apparatuses 400 and 800, by constructing an electric circuit of a power supplying battery 610 connected with the first and second driving apparatuses 400 and 800. The operation of any one button 622 on the control box 620 leads to the state of applying power to the first and second driving apparatuses 400 and 800, the state of causing the activation of only the first driving apparatus 400, the state of causing the activation of only the second driving apparatus 800, or the state of causing the activation of both the first and second driving apparatus 400 and 800. Such a construction is however a known art and so not described further. While a battery 610 already mounted in a vehicle was described in the foregoing example, a separate battery can be used.

Further, while the lifting apparatus for working at an elevated location 100, which is installed on a vehicle for the purpose of mobility and convenience, was described in the above, the apparatus may be installed on any transporting means beside the car, if only it is mobile.

FIG. 7 shows another embodiment of the first driving apparatus employed in a lifting apparatus for high-place working according to the invention.

The present embodiment is intended to directly drive the elastic strips 222*a*~222*d* by causing the winding drums 300*a*~300*d* to rotate through driving shafts 530*a*~530*d* and bevel gears 542, 546, 544 powered by the means of the driving force transmitted from the driving motor 510, wherein the driving shafts 530*a*~530*d* integrally provided on the respective winding drums 300*a*~300*d* are integrally interconnected through bevel gears 542, 546, 544 and a sprocket wheel 514 provided on a driving shaft 530*a* is connected to a sprocket wheel 512 provided on the driving shaft 520 of the driving motor 510 through a transmission chain 516, so that a driving apparatus 500 results, contrary to the above-described case wherein only a certain single winding drum 300*a* is driven by the first driving apparatus 400 to move elastic strips 222*a*~222*d*.

While such a driving apparatus 500 is complicated in construction compared to the driving apparatus 400, a bigger driving force can be imposed on the rotation of the winding drums 300*a*~300*d*. On the other hand, the construction of the first driving apparatuses as mentioned above is not restricted to that embodiment, but a variety of modifications may be allowable as long as the construction can influence the driving force for the winding drums.

FIG. 8 shows the front view of a combination of plural lifting apparatuses with a high-place working stand according to still other embodiment of the invention and FIG. 9 shows the plan view of FIG. 9.

The lifting apparatus for high-place working 100*a* according to this embodiment comprises a plurality of respective moving supporting legs 200*a*, 200*b* according to the first embodiment, arranged parallel to each other, for supporting a single working stand 700*a*. That is, in the lifting apparatus 100*a*, the first driving apparatus 400*a* functions such that the driving force produced from the first driving motor 410*a* is transmitted to all the winding drums 310*a*~310*d*; 320*a*~320*d* of the moving supporting legs 200*a* and 200*b*, by extending the driving shaft 420*a* of the first driving motor 410*a* to be coaxial with two winding drums 310*a* and 320*a*. Similarly, in the lifting apparatus 100*a*, the second driving motor 810*a* of the second driving apparatus 800*a* has its driving shaft 812*a* extended long up to guiding cases 210*a* and 210*b* for connection to the respective ratchet gears 830*a* and 830*b* in meshed engagement with the chains 840*a* and 840*b* which are respectively installed on one side of the rectangular columns 230*a* and 230*b* (Refer to FIGS. 8 and 9). Therefore, the second driving motor 810*a* can cause the simultaneous travel of the rectangular column 230*a* and 230*b* of the moving supporting legs 200*a* and 200*b*. This two-leg construction provides a solider and stabler support than the single moving supporting leg 200 in the foregoing embodiments. The rest construction and functions in the present embodiment are substantially the same as aforementioned embodiments and so concrete descriptions are not made.

As described above, an arbitrary high-elevation is accessible according to the present invention, because the elastic strips unwound from winding drums are caused continuously to form a supporting leg of rectangular form.

It is to be understood that, while the invention was described mainly with respect to specific embodiments, the invention is never restricted to those embodiments and a variety of modifications and alterations would be possible to a man skilled in the art by referring to the description or drawings presented here and within the spirit of the invention and thus those modifications or alterations are to fall within the scope of the invention, which scope should be limited only by the attached claim.

What is claimed is:

1. A lifting apparatus for high-place work comprising a moving supporting leg having a guiding case with opposite open ends and plural walls, guiding grooves attached to said walls, plural elastic strips movable through said guiding grooves for forming an integrated column for enhancing structural integrity, a plurality of connecting pieces transversely attached to said elastic strips with a proportional number of the connecting pieces being composed of shorter and longer lengths with the longer connecting pieces having fitting grooves on ends thereof, which matingly engage the ends of the shorter connecting pieces;

winding drums adapted to be disposed rotatably on a floor surface at positions corresponding to a respective one of the elastic strips for winding each of said elastic strips in the form of roll;

a first driving means disposed in the vicinity of the moving supporting leg for furnishing to said winding drums a driving force to wind the elastic strips through an axial connection to a respective one of said winding drums;

a second driving means disposed contiguous to one of the elastic strips of the moving supporting leg at a position isolated from the first driving means for furnishing a driving force to control the movement of the moving supporting leg in relation with the operation of the first driving means; and a controlling means for controlling the switching on or off of the first and second driving means.

2. The lifting apparatus for high-place work according to claim 1, wherein the guiding case is formed of metal plates with predetermined area and at least a pair of said guiding grooves are provided on two opposite walls of said plural walls at or near each said opposite open carts of said guiding case.

3. The lifting apparatus for high-place work according to claim 1, wherein the elastic strips forming said integrated column are integrally combined by a wrapping frame in the form of a band.

4. The lifting apparatus for high-place work according to claim 1, wherein the connecting pieces are formed of metal members with a predetermined strength.

5. The lifting apparatus for high-place work according to claim 1, the moving supporting leg is formed, on one of said opposite open ends, with a working stand for high-place workers.

6. The lifting apparatus for high-place work according to claim 1, the first driving means consists of a reversible motor.

7. The lifting apparatus for high-place work according to claim 1, wherein the second driving means comprises a ratchet gear rotatably mounted in a ratchet gear box which is formed, with a side toward the column open, on a side wall of the guiding case, so that the ratchet gear can be meshed in a chain provided over the full height of the elastic strip facing the gear box on the supporting leg, and a driving motor connected axially to the ratchet gear for transmitting, through a shaft, driving force to cause the meshing with the chain and for controlling the movement of the moving supporting leg.

8. The lifting apparatus for high-place work according to claim 1, wherein the controlling means comprises a control box having operation buttons, which allow selective on/off operation of one or both of the driving apparatuses, through an electric circuit of a power supplying battery electrically connected with the first and second driving apparatuses.

9. The lifting apparatus for high-place work according to claim 1, wherein two or more of said lifting apparatus for high-place work are connected to a single working stand to integrally support said stand.

10. The lifting apparatus for high-place work according to claim 1, wherein said lifting apparatus is installed on a movable transporting means.

* * * * *